US007344395B2

(12) United States Patent
Agethen et al.

(10) Patent No.: US 7,344,395 B2
(45) Date of Patent: Mar. 18, 2008

(54) ELECTRIC CONNECTION TERMINAL FOR A PRINTED CIRCUIT BOARD

(75) Inventors: Michael Agethen, Bielefeld (DE); Klaus Olejarz, Loehne (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/548,762

(22) Filed: Oct. 12, 2006

(65) Prior Publication Data

US 2007/0099497 A1 May 3, 2007

(30) Foreign Application Priority Data

Oct. 29, 2005 (DE) ..... 20 2005 017 012 U

(51) Int. Cl.
*H01R 13/53* (2006.01)

(52) U.S. Cl. ..... 439/181; 439/934

(58) Field of Classification Search ..... 439/181, 439/134, 135, 934, 78, 76.2
See application file for complete search history.

(56) References Cited

U.S. PATENT DOCUMENTS 5,462,451 A * 10/1995 Yeh ..... 439/493
5,571,022 A * 11/1996 Schaarschmidt ..... 439/135
5,582,180 A * 12/1996 Manset et al. ..... 600/508
6,151,046 A * 11/2000 Abe et al. ..... 347/50
6,799,983 B2 * 10/2004 Pavlovic et al. ..... 439/181
6,802,737 B2 * 10/2004 Bergner et al. ..... 439/532
7,201,586 B2 * 4/2007 Kohlenberg et al. ..... 439/76.2

FOREIGN PATENT DOCUMENTS

EP 1 289 075 A2 3/2003

* cited by examiner

*Primary Examiner*—Tulsidas C. Patel
*Assistant Examiner*—Harshad C Patel
(74) *Attorney, Agent, or Firm*—Hayes Soloway P.C.

(57) ABSTRACT

In an electric connector on a printed circuit board that features a connector part acted upon with relatively high electric voltage values, sparkovers between the continuing strip conductors arranged on the printed circuit board and the soldering points of the electric contacts are prevented by providing a snap-on element with several chamber in the connector part, wherein the chamber walls of this snap-on element can be inserted into slots arranged in the printed circuit board, and wherein the chambers respectively enclose the soldering point of one of the electric contacts in the connector part.

8 Claims, 6 Drawing Sheets

ELECTRIC CONNECTION TERMINAL FOR A PRINTED CIRCUIT BOARD

FIELD OF THE INVENTION

The invention pertains to an electric connection terminal for a printed circuit board that composed of a connector part, the insulating housing of which features several sockets in which electric contacts with a mating side and a terminal side are arranged.

BACKGROUND OF THE INVENTION

A connection terminal of this type is required for achieving greater creepage distances and clearances for spark over voltages in electric contacts that are arranged relatively close to one another in a connector housing and also acted upon with higher voltage values. In this case, a higher electric strength is also ensured in the direct mating region on the printed circuit board.

DESCRIPTION OF THE RELATED ART

EP 1 289 075 discloses a plug connector with an insulating and sealing element of an elastic insulating material with high electric strength that is arranged on the bottom of a plug connector housing and provided with through-openings for the electric contacts.

SUMMARY OF THE INVENTION

Consequently, the invention is based on the objective of designing a connection terminal for producing a plug-type connection on a printed circuit board in such a way that the safety clearance realized for the continuing strip conductors connected to the electric contacts of the connector part suffices for preventing sparkover voltages between the strip conductors when higher voltages are transmitted to the printed circuit board.

This objective is attained in that the terminal sides of the electric contacts protrude at least partially into separate chambers of a snap-on element that can be positioned over the sockets of the connector part from the terminal side.

The inventive connection terminal consisting of a connector part and a snap-on element is rigidly connected to a printed circuit board and designed for producing a direct electric connection for relatively high voltages of approximately 450 V per electric contact with a mating connector.

The advantages attained with the invention can be seen, in particular, in that the snap-on element provided with separate chambers at least regionally encloses the electric contacts arranged in an insulating member of the connector part, and in that a separation of the soldering points connecting the electric contacts with the electric strip conductors on the printed circuit board is simultaneously ensured.

The connector part is manufactured from an electrically insulating material and features a square support plate with several sockets inserted or integrated therein, wherein the electric contacts are inserted into these sockets such that they protrude from the sockets in the form of connector pins on one side and in the form of terminal pins on the other side.

The connector part is placed on the component side of the printed circuit board with the side featuring the terminal pins such that the electric contacts are inserted into the bores and can be subsequently soldered to the soldering points on the rear side (solder side).

The snap-on element with the chamber walls forming the chambers is then inserted into the slots provided in the printed circuit board for this purpose from the solder side such that the chamber walls enclose a region of the electric contacts above and underneath the support plate and, in particular, separate the individual soldering points, wherein the regions that respectively point outward remain open.

In addition, it is possible to provide an interlocking connection between the connector part and the snap-on element such that forces—tensile or shearing forces—acting upon the connector part and the electric contacts are transmitted to the printed circuit board via the interlocking connection so as to alleviate the load on the soldering points on the printed circuit board.

BRIEF DESCRIPTION OF THE DRAWINGS

One embodiment of the invention is illustrated in the figures and described in greater detail below. The figures show.

DETAILED DESCRIPTION OF THE INVENTION

Figure 1:
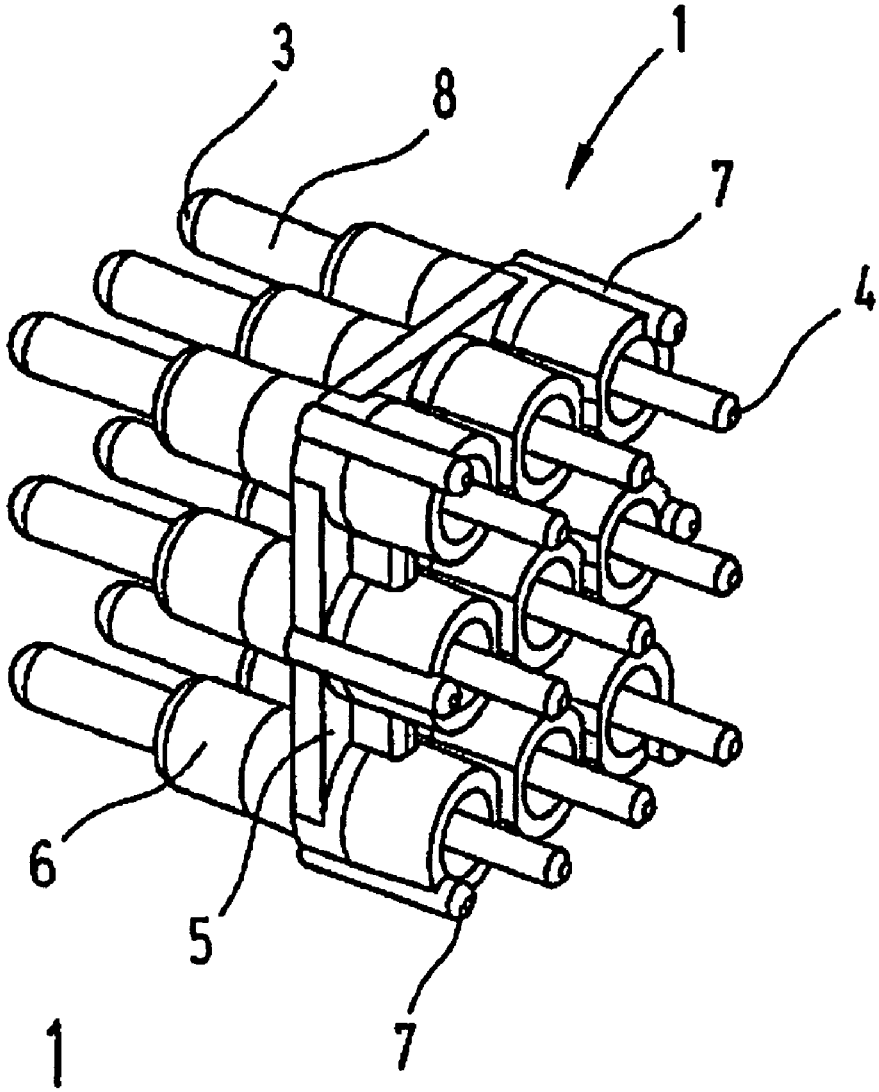
FIG. 1, a perspective representation of a connector part.
Figure 5:
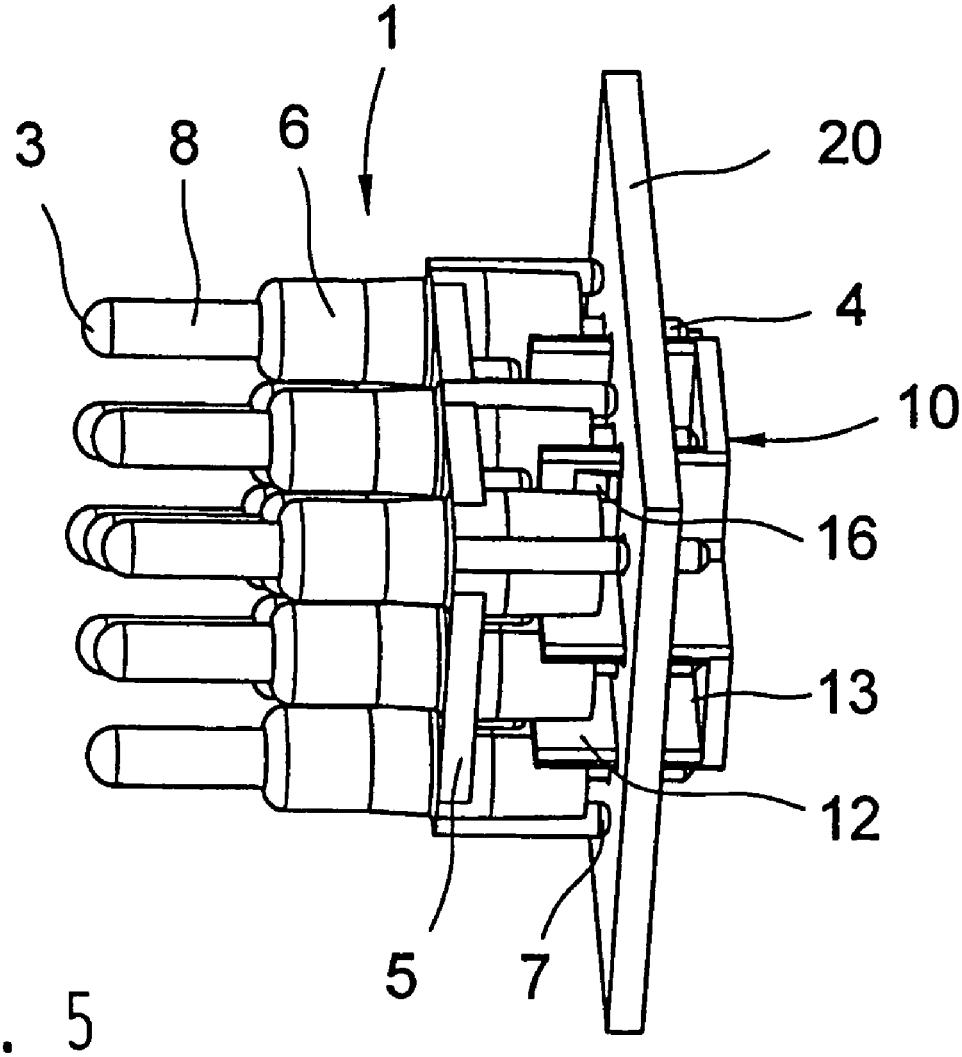
FIG. 5, another illustration of the connector part with the snap-on element, and FIG. 6, a detailed representation of a mounted snap-on element with the connector part.

FIG. 1 shows an isometric representation of a connector part 1 of an electric connection terminal to be mounted on a printed circuit board 20. (FIG. 5).

The connector part comprises a support plate 5 that is manufactured from an insulating material and contains sockets 6 for accommodating electric contacts 8 with a mating side 3 and a terminal side 4 that is realized in the form of the solder side in this case.

The support plate 5 is arranged centrally referred to the length of the sockets 6 and extends approximately perpendicular thereto. Spacers 7 moulded onto the respective outer sockets 6 ensure that a minimum distance between the sockets and the printed circuit board is maintained.

Figure 2:
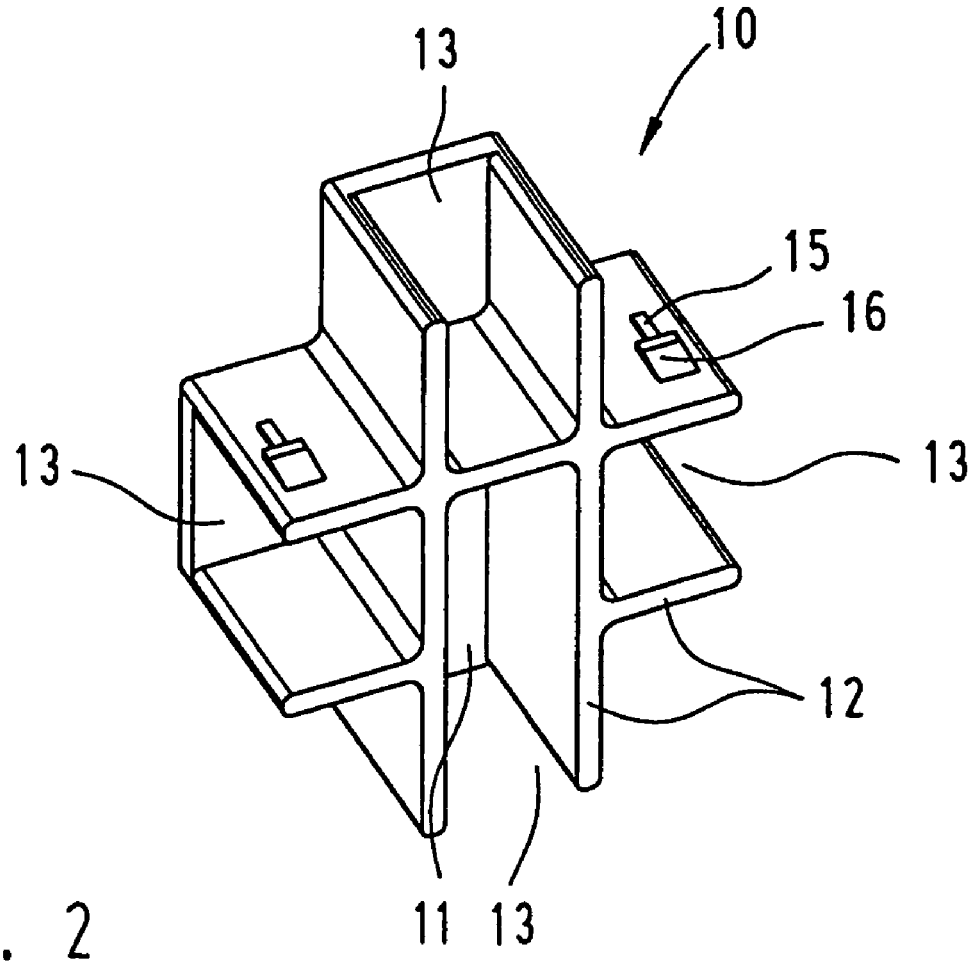
FIG. 2, a perspective representation of a snap-on element.

FIG. 2 shows an embodiment of a snap-on element 10 with an isosceles, cruciform base plate 11 and vertically aligned chamber walls 12 moulded thereon.

In this case, a total of four chambers 13 are formed, wherein three chambers have a square shape and one chamber has a rectangular shape, and wherein the rectangular chamber has a size that corresponds to that of two square chambers.

One peculiarity of the chambers is that the respective sides that point outward are open rather than closed with a wall.

Likewise, the outwardly positioned corner regions are open on two sides.

Hooks 16 are moulded onto the respective outer sides of the horizontally arranged chamber walls and can be engaged with the snap-on element 10 after it is inserted into the printed circuit board 20, wherein the webs 15 attached to the hooks 16 are provided for ensuring a secure seat of the snap-on element.

Figure 3:
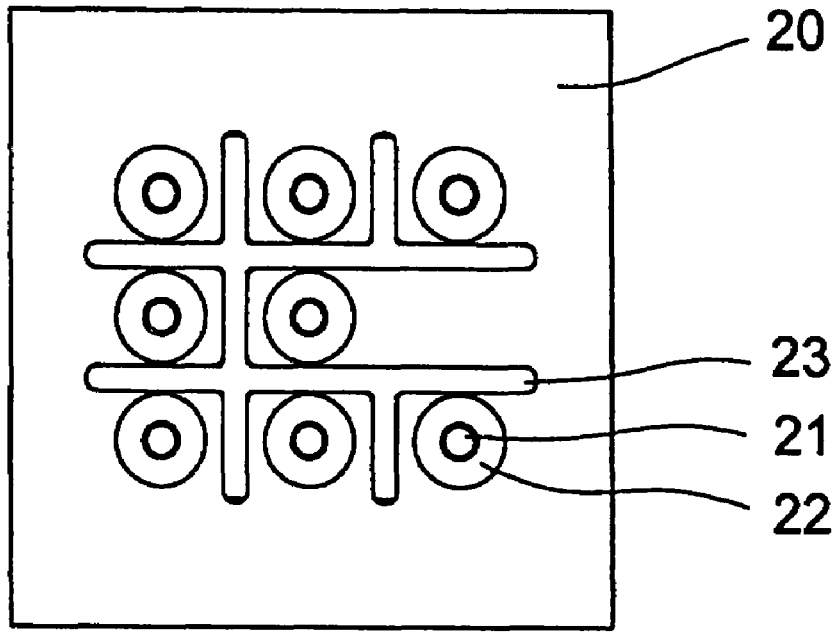
FIG. 3, an illustration of a printed circuit board that features slots and soldering points.

FIG. 3 shows a detail of a printed circuit board 20 with several bores 21 arranged therein, wherein rectangularly aligned slots 23 are arranged between the bores.

This figure shows eight bores 21 with soldering points 22 that serve as connecting points for being soldered to the terminal side 4 of the electric contacts of the connector part.

The regular strip conductors connected to the soldering points 22 are not illustrated in the figure.

However, one can ascertain that each soldering or connecting point 22 is respectively separated from the adjacent soldering or connecting point by the slots 23.

Figure 4:
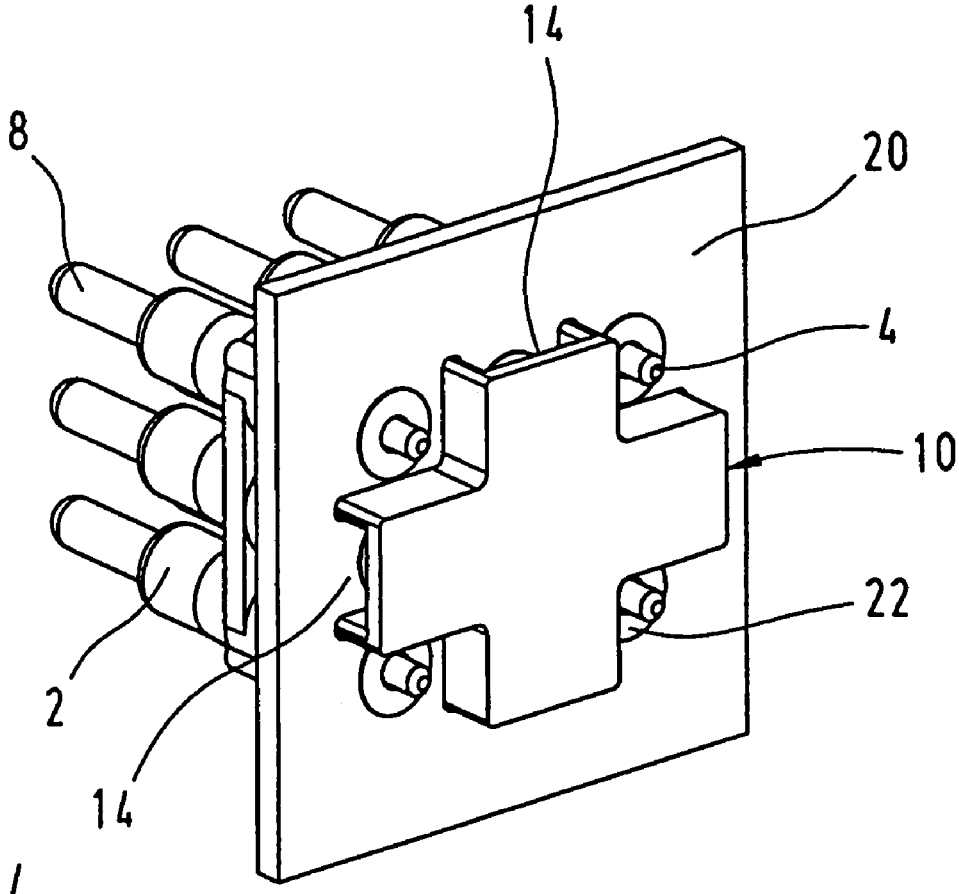
FIG. 4, a connector part with a snap-on element that is mounted on the printed circuit board.

FIG. 4 shows an isometric representation, in which the predominant viewing direction is directed at the solder side of the printed circuit board 20, the snap-on element 10 inserted into the slots 23, as well as the connector part 1 with the housing 2 that is inserted into the bores 21 of the soldering points 22, wherein the solder or terminal side 4 of the electric contacts 8 already protrudes from the bores 21 on the solder side of the printed circuit board. One can ascertain that the end faces of the cross respectively feature an open side 14, wherein all soldering points 22 and the contacts 8 are separated from one another in an electrically insulated fashion as well as optically.

FIG. 5 shows a side view of the connector part 1 arranged above the printed circuit board 20 (in this case on the left side) and the snap-on element 10 that is inserted into these slots 23 with the chamber walls 12 underneath the printed circuit board (in this case on the right side).

The spacers 7 are moulded onto the outer regions of the corner sockets 6, wherein these spacers begin at the support plate 5 and ensure that a minimum distance between the sockets 6 and the printed circuit board 20 is maintained.

Figure 6:
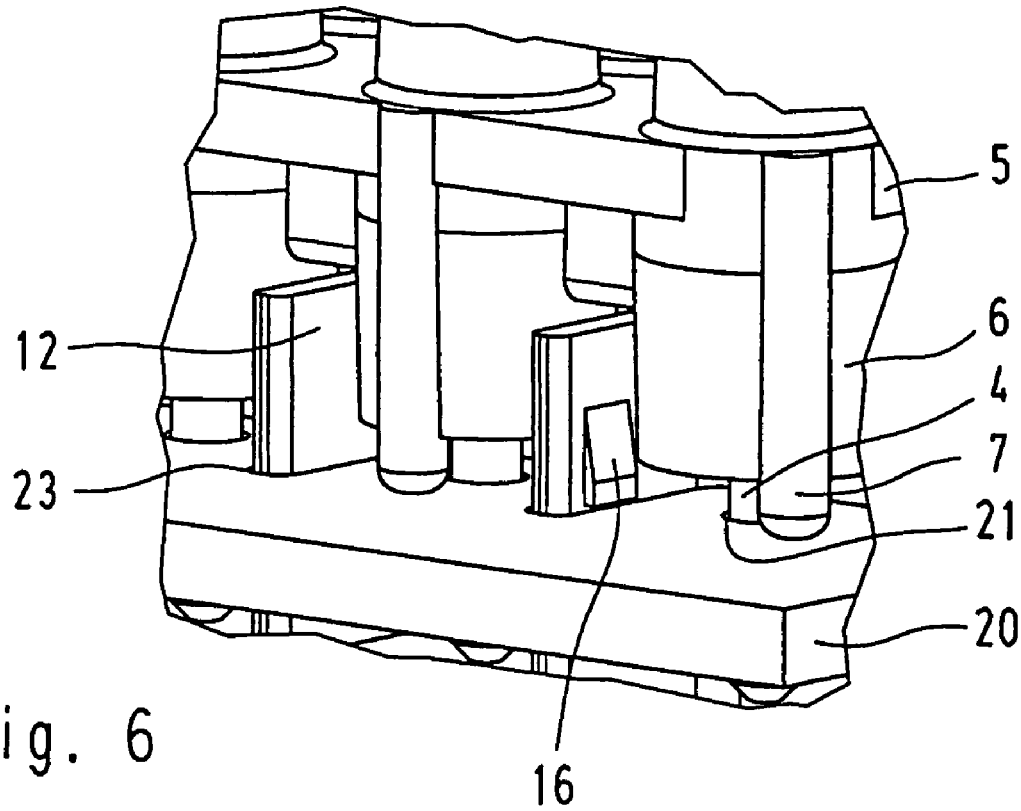

FIG. 6 shows a significantly enlarged detail of FIG. 5.

This figure shows the sockets 6 that are respectively arranged separately in the individual chambers 13 of the snap-on element 10, as well as the terminal sides 4 of the electric contacts arranged in these sockets.

The chamber walls 12 are inserted into the slots 23, wherein this figure also shows one of the hooks 16 that engages with the snap-on element 10 on the component side of the printed circuit board 20 when it is pushed through the slots 23.

What is claimed is:

1. A connection terminal for a printed circuit board, comprising a connector part having a plurality of sockets in which a plurality of electric contacts with a mating side and a terminal side are arranged, wherein the terminal sides of the electric contacts protrude at least partially through said printed circuit board into separate chambers of a snap-on element positioned over the terminal sides of the electric contacts, and wherein the snap-on element is inserted into correspondingly shaped slots in the printed circuit board with the chamber walls and interlocked by hooks.

2. The connection terminal according to claim 1, wherein the separate chambers of the snap-on element are formed by chamber walls that are moulded onto a base plate perpendicular thereto.

3. A connection terminal according to claim 1, wherein said connector part is comprised of a support plate made of an insulating material, said plurality of sockets being arranged perpendicular to said support plate.

4. A connection terminal according to claim 3, wherein said connector part is further comprised of a plurality of spacers to ensure that a minimum distance is maintained between the sockets and the printed circuit board.

5. A connection terminal according to claim 1, wherein each of said separate chambers formed by the snap-on element are open on at least on side.

6. A connection terminal for a printed circuit board, comprising a connector part in which a plurality of electric contacts with a mating side and a terminal side are arranged, wherein the terminal sides of the electric contacts protrude at least partially through said printed circuit board into separate chambers of a snap-on element positioned over the terminal sides of the electric contacts, and wherein the snap-on element is fixed on the printed circuit board by an interlocking device.

7. A connection terminal according to claim 6, wherein said connector part is comprised of a support plate made of an insulating material and a plurality of sockets, said plurality of sockets being arranged perpendicular to said support plate.

8. A connection terminal according to claim 7, wherein said connector part is further comprised of a plurality of spacers to ensure that a minimum distance is maintained between the sockets and the printed circuit board.

* * * * *